US005237928A

United States Patent [19]

Redecker

[11] Patent Number: 5,237,928

[45] Date of Patent: Aug. 24, 1993

[54] COMBUSTIBLE CARTRIDGE CASE

[75] Inventor: Klaus Redecker, Nuremberg, Fed. Rep. of Germany

[73] Assignee: Dynamit Nobel Aktiengesellschaft, Troisdorf, Fed. Rep. of Germany

[21] Appl. No.: 870,235

[22] Filed: Apr. 20, 1992

Related U.S. Application Data

[63] Continuation of Ser. No. 386,804, Jul. 28, 1989, abandoned.

[30] Foreign Application Priority Data

Jul. 28, 1988 [DE] Fed. Rep. of Germany ..... 3825581

[51] Int. Cl.[5] ..... F42B 5/196

[52] U.S. Cl. ..... 102/431; 149/105

[58] Field of Search ..... 102/431, 432, 433, 700; 149/105

[56] References Cited

U.S. PATENT DOCUMENTS

| | | | |
|---|---|---|---|
| 3,769,873 | 11/1973 | Abel | 102/431 |
| 3,847,081 | 11/1974 | Quinlan et al. | 102/433 |
| 4,250,294 | 2/1981 | Hagel et al. | 149/105 |
| 4,649,827 | 3/1987 | Brasquies et al. | 102/431 |
| 4,724,017 | 2/1988 | Eich et al. | 102/431 |

FOREIGN PATENT DOCUMENTS

| | | | |
|---|---|---|---|
| 1445056 | 8/1976 | United Kingdom | 102/700 |

*Primary Examiner*—Stephen C. Bentley
*Attorney, Agent, or Firm*—Antonelli, Terry, Stout & Kraus

[57] ABSTRACT

Combustible cartridge shells have cylindrical walls formed of combustible material. The walls comprise one or more wraps or windings of textile fibers, which are bound together with bonding agents having propellant charge characteristics. The bonding agents comprise either a mixture of polymers and explosives with decomposition temperatures above 180° C. or a mixture of polymeric nitro-aromatic compounds which have two or more nitro groups per aromatic nucleus and also have a decomposition temperature above 180° C. Mixtures of these two bonding agents may also be used to form the cylindrical wall of the combustible cartridge shell. The cartridge shells have inherently stable walls with a high mechanical resistance and are unaffected by changes in temperature up to 240° C. Advantageously, these shells burn practically free of any residuals.

7 Claims, No Drawings

COMBUSTIBLE CARTRIDGE CASE

This application is a continuation application of application Ser. No. 386,804, filed Jul. 28, 1989, now abandoned.

The substance of the invention in question is a combustible or dissipative cartridge shell for munitions whose wall consists of one or more rolls of textile fibers which are bound with bonding agents.

Combustible or dissipative cartridge shells whose walls have multiple rolls of textile fibers are known, for instance per DE-OS 24 24 900. The textile fibers are nitrified and reinforced by synthetic fibers. The individual twists are bound to each other and stiffened with a bonding agent. Nitrocellulose is the preferred bonding agent, but other plastics may be used.

These known combustible or dissipative cartridge shells, however, have the following disadvantages:

It is known when using metal-free cartridge shells to shoot, resultant energy cannot be eliminated, so that the cartridge chamber becomes hot more quickly than when metal shells are used. In addition, combustible shells lose part of their combustion heat to the cartridge chamber, as well. Because of these characteristics, the cartridge chamber can become so hot after just a few shots that premature ignition of the munitions in the cartridge chamber results. Such premature ignition occurs especially with munitions whose propellant charges do not have sufficient temperature stability. The propellant charges described in DE-OS 24 24 900 have such an insufficient temperature stability because the nitrified textile fibers behave almost like nitrocellulose and can dissipate explosively at temperatures above 150 deg. C. as a result of autocatalysis. These temperatures are achieved with just short periods of shooting with metal-free shells.

There was therefore a need to create combustible cartridge shells which are thermally unaffected by temperatures above 150 deg. C. in the cartridge chamber and which have a high mechanical resistance. The high mechanical resistance is important in order to protect the propellant charge against, among other things, exterior mechanical influences in the storage and handling of the munitions and to take over the sealing function in the cartridge chamber before shooting.

Found to satisfy this need were combustible or dissipative cartridge shells for munitions whose walls consist of one or more rolls of textile fibers bound with bonding agents and which are notable in that they have as bonding agents which have propellant charge characteristics and comprise either a mixture of polymers and explosives with decomposition temperatures above 180° C. or polymeric nitro-aromatics which have two or more nitro groups per aromatic nucleus and also have a decompsition temperature above 180° C. or mixtures of either of these bonding agents.

The bonding agents which can be used in the invention can themselves have propellant charge characteristics; in these cases they can be used without the addition of explosives which are affected by high temperatures.

Bonding agents which themselves do not have any propellant charge characteristics are used in a mixture with explosives which are affected by high temperatures. The proportion of explosives in this mixture can range from 30 to 70% by weight and is preferably between 40 and 60% by weight.

The known thermoplastic polymers suitable as bonding agents for this area of application are those which burn free of residue and which form no corrosive gases through combustion. Especially suitable are those products produced by the reaction of polyvinyl alcohol with aldehydes which have 1 to 6 C atoms, which are also called polyvinyl acetals. Use of polyvinyl butyral is preferred.

In addition, those polymers are suitable as bonding agents for the invention which can be used monomerously and which undergo a radically triggered condensation or polymerization after being mixed with a suitable initiator or cross-linker. To these connections belong, among others, methyl acrylate and acrylonitrile.

Polyurethane, polyester, epoxy resin, or rubber can also be used as bonding agents in the forms of solutions or watery emulsions.

Known, gas-yielding, stable organic nitro compounds, nitrosamines, and ammonium nitrates which are thermally stable above 180 deg. C. belong to the explosives which can withstand high temperatures and which can be used with the bonding agents per the invention. The organic nitro compounds are, for example, those that are derived from mononuclear nitrified aromatics like the di- and triamino compounds of symmetrical trinitrobenzene, their acyl products, like for example s-hexanitrooxanilide or s-hexanitrodiphenyl urea, and salts of picric acid like ammonium-or guanidine picrate. Binuclear nitrified aromatics which are either bonded to each other with carbon atoms (like for example nitrified diphenyl), their 3.3' diamine compound and s-hexanitrostilbs or binuclear nitrified aromatics which are bound to each other over heteroatoms like oxygen, sulfur, or nitrogen, also fall into this group. Examples of the last group are hexanitrodiphenyl oxide, hexanitrodiphenyl sulfide, hexanitrodiphenyl sulfone, and hexanitrodiphenyl amine. Also belonging to this group are heterocycles containing picrates like thiophene, 1.3 thiazole, triazine or pyrimidine; nitrified heterocycles like tetranitro carbazole, tetranitro acridone, or tacot, an extremely safe explosive of tetranitro-2.3:5.6-dibenzo-1.3a, 4.61 tetraazapental.

The thermally-stable ammonium nitrate and nitrosamine explosives which can be used for the invention are less extensive. Examples of these are hexanitrodiphenylaminoethylnitrate which in comparison to hexanitrodiphenylamine achieves more stability through the substitution of N—H hydrogen. As a nitro amino connection, octogen has the greatest importance in its two stereoisomer forms $\alpha$ and $\beta$, especially in the latter.

Bonding agents based on polymeric nitro aromatics, which possess propellant charge characteristics, are primarily polymerization products from dichloropolynitrobenzoles or dichloropolynitrodiphenyls. The polymerizates are either homopolymers of these compounds which are obtained in the presence of copper powder in an "Ullman" reaction, or are reaction products of these aromatics with nitrified hydroquinones. The compounds which are specifically mentioned here are described in examples in DE-PS 27 52 166-C2 and DE 30 23 462-A1.

The polymeric nitro aromatics can be used as bonding agents per the invention either alone or also in a mixture with the above-named bonding agents.

In addition to the explosives, oxygen-deliverers can be released or yielded dispersed either alone or in a mixture with metal powder. Oxidation means from the groups of metal peroxides, alkali and alkaline earth nitrates, or peroxide sulfate are possible for oxygen-deliverers. The preferred means of oxidation is zinc peroxide. Primarily titanium, zirconium, magnesium, cermagnesium, cersilicon, and aluminium-magnesium alloys are suitable as metals.

The oxidation means are used in amounts of 0 to 50% by weight in reference to the bonding agent mixture, and the metals are used in amounts of 0 to 20% by weight in reference to the bonding agent mixture. When the oxidation means and metals are used jointly, the two groups of substances are preferably used in such a ratio to each other that they burn like a pyrotechnical mixture.

The threads which can be used for the invention are easily combustible textile threads which are themselves known as reinforcement fibers in the production of cartridge shells. Both fully synthetic and natural fibers can be used which are combustible or dissipative at the combustion temperature of the propellant charge powders. Combustible fibers are those fibers which decompose primarily into gaseous products and/or into finely divided particles at the combustion temperature of the propellant charge powder.

Fibers which make a contribution to the oxygen content of the propellant charge powder through their combustion or dissipation are preferably used.

Fibers which are likewise preferred are organic, easily combustible fibers like polyester or polyamide fibers. Polyester fibers are such fibers as are won from condensation products of aromatic dicarboxylic acids, especially terephthalic acids or their ester with diols. Examples of polymide fibers are the different types of nylon.

Apart from the named fully and half-synthetic fibers, however, other full and half-synthetic fibers can also be used, like, for example, polyolefin fibers (for example, polyethylene or polypropylene fibers), polyacrylic fibers, for example poly(meth)acrylic fibers or fibers of polymerisates which result from the addition of polyglycols to diisocyanate (polyurethane fibers). Examples of further half-synthetic fibers are those from modified polymers of natural materials, like for example those of cellulose bases. To these belong cellulose acetate fibers with an acetyl group content between 74 and 92%, whereby the acetyl groups can also subsequently be fully or partially hydrolized by hydrolosis, or cellulose fibers which are produced after the copper-ammonia process from regenerated cellulose or after the viscous process from cellulose. The latter are also known under the designation rayon.

Furthermore, it is possible to use fibers from inorganic materials which likewise are dissipative at the combustion temperature of the propulsion agent/bonding mixture and which form atomizable combustion products. Included in these are metal fibers or glass fibers.

To additional usable fibers belong also graphite fibers or other carbon fibers.

Examples of natural fibers are those that are of casein or cotton, hemp, or jute fibers.

Production of the invented cartridge shells is done by a known method: the fibers are wound around a spindle. Preferably several wrapping layers with defined fiber tension are put on. The wrapping of several layers can be done for each layer in a direction and pitch different from that of the previous and/or subsequent layer so that the fibers of one layer cross the fibers of a layer on top or underneath. It is also possible that one or more layers of fibers are laid in lengthwise to the shell.

The individual fibers can have any cross section; preferably they have a circular cross-section with a diameter of 15 to 25μm. These fibers can consist of a number of individual, significantly thinner filaments which are made into the fibers to be wrapped before wrapping.

The application of the invention's bonding agent is done preferably before the fibers are wrapped on the spindle. In addition to the explosives, the bonding agents may also contain, dissolved or homogeneously dispersed, the oxidation means, metal powder or other known additional materials for propulsion agents, like fire moderators or means of achieving porosity.

It is, however, also possible to apply the bonding agent during the wrapping process, by spraying it on the fibers, for example, or even to apply it to the finished roll, for example by dipping the wrapped bundle of fibers in the bonding agent.

After producing the roll to which the bonding agent and additional materials have been applied, the bonding agent is allowed to set, possibly at an elevated temperature. If necessary it is also relieved of the solvent.

After setting, the roll is worked by a known method into the desired geometry for the cartridge shells. It may be subjected to an additional layer on the outer surface to achieve better antifriction properties in the weapon.

The claimed cartridge shells preferably have an exterior diameter of more than 20 mm. They are stable against thermal decomposition at temperatures above 150 deg C., depending on the chosen composition, up to 250 deg C., possess a sufficient form stability and mechanical resistance to protect them from outside influences in storage and handling, and to be able to take over the seal function in the cartridge chamber.

In addition, the shells when shot burn practically free of residuals or dissipate in the formation of dissipative particle-forming products which are easily removed from the cartridge chamber, so that a quick rate of fire is provided.

EXAMPLE 1

A viscous fiber was wrapped or wound in a single layer to a width of approximately 10 cm at an angle of approximately 10 deg. from the vertical to the horizontal axis around a rotating glass pipe with a diameter of 15 mm.

This was coated with a mixture made of an acrylic resin emulsion in water with 50% solid portion and octogen (1:1, referring to the solid portion), and was dried lightly with warm air. The next layer of viscous fiber was applied to the still-soft layer as described in the opposite direction. The second fiber layer was treated in the same manner. This process was repeated up to a six-fold fiber density. The finished roll or cylinder was then put in the oven to set for 30 minutes at 150 deg. C. After this process, after the removal of the glass pipe, a fixed a wall thickness of 0.8 mm. remained. It consisted of approximately 20% by weight fiber portion and the rest of octogen/bonders in a weight ratio of 1:1.

A tube for testing was cut into small pieces and put into a glass tube, which was heated in Wood's alloy with 20 K./min. At 244 deg C. strong smoke development by dissipation of the components was observed. The ignition of a wrapped test piece with a gas flame resulted in spontaneous combustion with almost complete decomposition.

EXAMPLE 2

A tube was produced as described in Example 1, whereby a mixture consisting of 5 g. polyvinyl-n-butyral and 5 g. polynitropolyphenyl in 40 g. of a solvent mixture of ethylacetate (70% vol), butyl acetate (15% vol), and ethanol (15% vol) was applied to the roll. After the production of the six roll layers, the wall strength of the tube dried at 100 deg. C. for one hour was 0.4 mm. The fiber portion was 11.2% by weight; the explosion point determined by the above method was 235 deg. C. Combustion under normal pressure was violent and likewise led to an almost residual-free decomposition.

EXAMPLE 3

Procedure was conducted analogously to Examples 1 and 2. The application, however, consisted of a mixture of cellulose acetate in organic solutions with solid content of 34% by weight and octogen in a weight ratio of 1:1 (referring to the solid). After the six roll layers were finished, it was heated at 100 deg. C. for one hour. The tube, after removal of the glass pipe, had a wall strength of 0.5 mm. The fiber portion was 16.1% by weight, the explosion point was at 253 deg. C. Combustion under normal pressure was violent with release of soot. This formation of soot can be reduced by the addition of an oxidation means.

I claim:

1. A combustible cartridge shell for munitions having a cylindrical wall containing at least one winding of textile fibers which are bound together with a bonding agent; said bonding agent comprising at least one of the components:

(a) a mixture comprising a polymer which when burned forms no corrosive gases and an explosive material whose decomposition temperatures are over 180° C., and (b) polymeric nitro-aromatic compounds having a decomposition temperature above 180° C. and having an average of at least two nitro groups per aromatic nucleus;

said textile fibers consisting of combustible synthetic and natural fibers.

2. A cartridge shell according to claim 1, wherein in component (a) the proportion of polymers in the shell is between 10 and 50% by weight and in component (b), the proportion of polymeric nitro-aromatic compounds is between 10 and 90%.

3. A cartridge shell according to claim 1, wherein in component (a), the proportion of polymers in the shell is between 10 and 20% by weight and in component (b) the proportion of polymeric nitro-aromatic compounds is between 10 and 90% by weight.

4. A cartridge shell according to claim 1, wherein the proportion of explosive material in the component (a) is between 30 and 70% by weight.

5. A cartridge shell according to claim 2, wherein the proportion of explosive material in the component (a) is between 30 and 70% by weight.

6. A cartridge shell according to claim 1, wherein said bonding agent consists of component (a).

7. A cartridge shell according to claim 1, wherein said bonding agent consists of component (b).

* * * * *